US009468282B2

(12) United States Patent
Schreiber

(10) Patent No.: US 9,468,282 B2
(45) Date of Patent: Oct. 18, 2016

(54) APPLICATOR ASSEMBLY COMPRISING A RECEPTACLE FOR A COSMETIC PRODUCT AND AN APPLICATOR SUB-ASSEMBLY

(71) Applicant: Albea Services, Gennevilliers (FR)

(72) Inventor: Camille Schreiber, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 164 days.

(21) Appl. No.: 14/499,456

(22) Filed: Sep. 29, 2014

(65) Prior Publication Data

US 2015/0093174 A1 Apr. 2, 2015

(30) Foreign Application Priority Data

Sep. 30, 2013 (FR) ..... 13 59383

(51) Int. Cl.
*A45D 40/26* (2006.01)
*A46B 9/02* (2006.01)

(52) U.S. Cl.
CPC ..... *A45D 40/267* (2013.01); *A46B 9/021* (2013.01); *A46B 2200/1053* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,896,823 A | 7/1975 | Spatz | | |
| 3,930,280 A | 1/1976 | Vasas | | |
| 6,532,967 B1 * | 3/2003 | Dumler | A46B 9/021 | 132/218 |
| 8,944,714 B2 * | 2/2015 | Gueret | A45D 40/267 | 401/126 |
| 2007/0033759 A1 * | 2/2007 | Dumler | A45D 40/262 | 15/187 |
| 2008/0023020 A1 * | 1/2008 | Gueret | A45D 40/265 | 132/218 |

FOREIGN PATENT DOCUMENTS

| | | |
|---|---|---|
| EP | 1053695 | 11/2000 |
| EP | 1306029 | 5/2003 |
| EP | 2229839 | 9/2010 |
| FR | 2918255 | 1/2009 |
| FR | 2922422 | 4/2009 |

OTHER PUBLICATIONS

French Application No. 1359383, International Search Report, dated Jun. 27, 2014.

* cited by examiner

*Primary Examiner* — David Walczak

(74) *Attorney, Agent, or Firm* — Banner & Witcoff, Ltd.

(57) ABSTRACT

An applicator assembly comprising a receptacle for a cosmetic product and an applicator sub-assembly, the applicator sub-assembly comprising an applicator and a rod, the applicator comprising a core having a first end capable of being attached to said rod, and a second, free end, said receptacle comprising a wiper for wiping some of the product on the rod and/or the applicator, the core being designed to brush past the wiper in a plurality of distinct regions.

9 Claims, 3 Drawing Sheets

Figure 5:
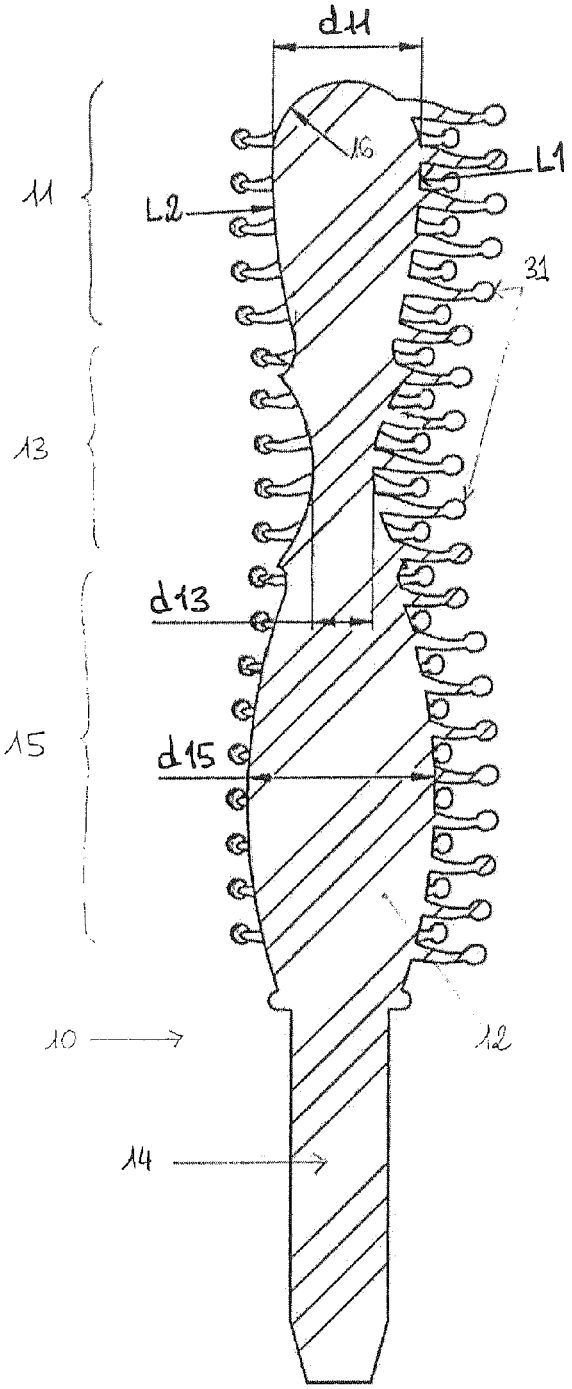

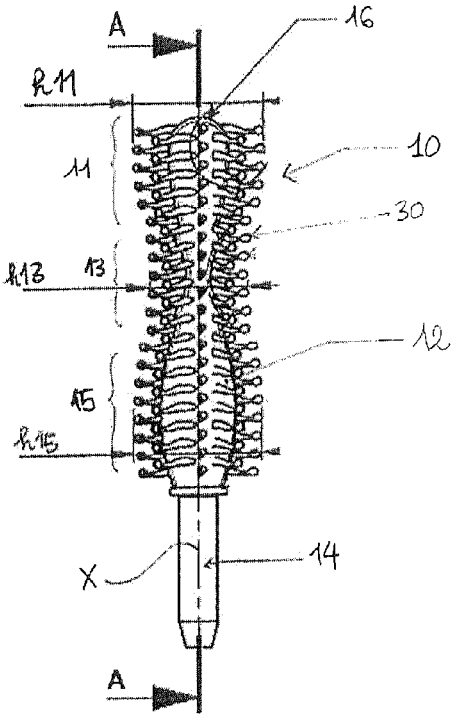
Figure 1
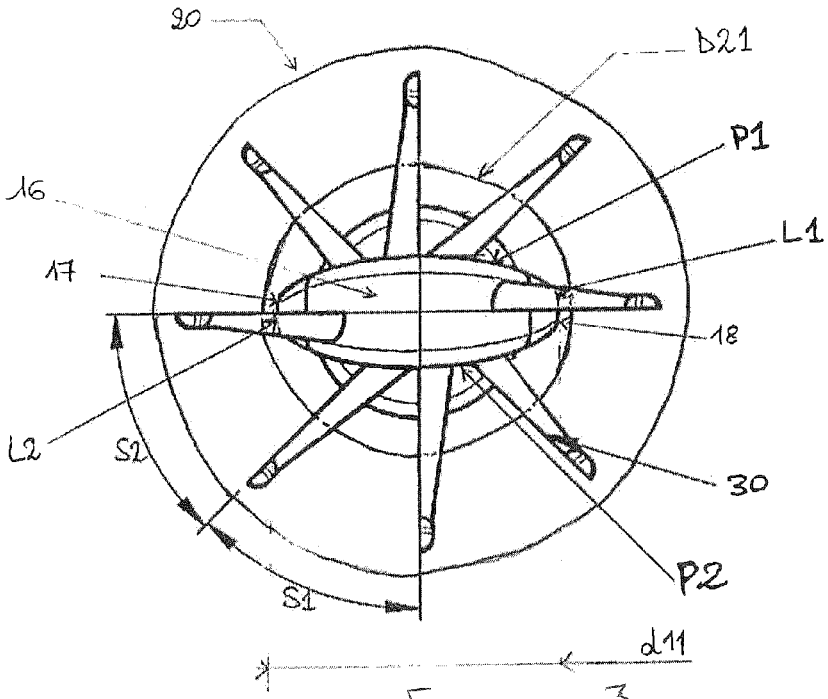
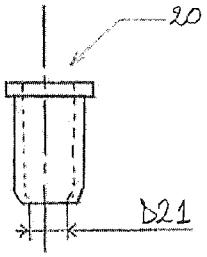
Figure 2
Figure 3

APPLICATOR ASSEMBLY COMPRISING A RECEPTACLE FOR A COSMETIC PRODUCT AND AN APPLICATOR SUB-ASSEMBLY

The invention relates to an applicator assembly comprising a receptacle for a cosmetic product and an applicator sub-assembly.

Applicator assemblies for cosmetic products, in particular for cosmetic products to be applied to the eyelashes, such as mascara, comprising a receptacle containing the cosmetic product and an applicator sub-assembly capable of being removably attached to the receptacle, are known.

The receptacle generally comprises a body, the body having walls which delimit a container for containing the cosmetic product, and a neck defining an opening through which the cosmetic product can be removed.

The applicator sub-assembly generally comprises a cap which can be attached to the neck, a rod extending from the cap and an applicator attached to a free end of the rod. The applicator comprises a core and a plurality of protrusions or bristles extending from the core.

When the cap is attached to the neck, the rod and the applicator extend within the container. The applicator is immersed in the cosmetic product contained in the container.

To use the applicator, the user detaches the cap from the neck and removes the applicator from the receptacle.

To prevent the applicator from becoming overloaded with cosmetic product, the receptacle generally comprises a wiper attached within the neck. When the user removes the applicator from the receptacle, the rod and the applicator slide within the wiper. The wiper scrapes the excess cosmetic product from the rod and the applicator.

The wiper thus makes it possible to control the amount of product which is on the brush and prevents an excessive amount of cosmetic product from being applied to the eyelashes.

However, the wiper does not make it possible to remove the excess cosmetic product from the free end of the applicator.

Cosmetic product residue can thus remain on the end of the applicator, and this is unsightly and may reduce the quality of the cosmetic product application. For example, this residue may come into contact with the user's eye or skin when they comb mascara through the eyelashes and/or load the eyelashes at the corners of the eyes with mascara.

This disadvantage does not exist, or is lessened, in the case of a cosmetic product to be applied that has the property of being very "runny", for example in the case in which the cosmetic product to be applied is intended for being applied to the lips.

A problem addressed by the invention is that of limiting cosmetic product deposits on the free end of the applicator.

The invention thus relates to an applicator assembly comprising a receptacle for a cosmetic product and an applicator sub-assembly, the applicator sub-assembly comprising an applicator and a rod, the applicator comprising a core having a first end capable of being attached to said rod, and a second, free end, said receptacle comprising a wiper for wiping some of the product from the rod and/or the applicator.

According to the invention, the core is designed to brush past the wiper in a plurality of distinct regions.

In the following, "brush past" means come close with or without contact. In other words, there is slight play, or slight friction, between the core and the wiper, for example resulting from a difference in radius of less than 1 mm, or 0.5 mm, or even 0.2 mm.

In this way, there is a shearing effect on the cosmetic product residue present on said second end. The proposed applicator assembly thus allows the presence of cosmetic product residue at the free end of the applicator that remains in the receptacle to be limited owing to the shearing. The applicator remains clean and the cosmetic product can be applied to the eyelashes precisely and without overloading.

According to various embodiments of the invention, which may be taken in isolation or in combination:

- the core has a rounded portion, at least adjacent to said second end,
- said distinct regions intended to brush past the wiper are positioned in said rounded region,
- said regions intended to brush past the wiper are opposite one another in pairs,
- the rounded portion has, in a given direction, an external size close to an internal diameter of the wiper,
- said regions intended to brush past the wiper are positioned on either side of said rounded portion in said given direction,
- the applicator comprises a plurality of protrusions projecting from the core, the plurality of regions designed to brush past the wiper comprising at most one protrusion,
- said free end is domed,
- said free end does not have any protrusions,
- said free part is connected to the rounded portion in a convex manner,
- the core comprises two substantially planar faces,
- the core comprises lateral surfaces connecting the substantially planar faces,
- the rounded portion gives the lateral surfaces an undulating profile,
- the core comprises another rounded portion adjacent to said first end,
- the core comprises at least one narrowed portion between the rounded portion adjacent to the first end and that adjacent to the second end,
- the narrowed portion of the core is located in a region referred to as the central region of the core,
- the narrowed portion has a concave orientation, the core has a substantially rectangular cross section,
- the core is solid,
- the core is made of plastics material,
- the protrusions are integrally formed with the core,
- a first plurality of protrusions project from the rounded part(s) and from the narrowed part(s),
- said first plurality of protrusions comprises teeth of the same height,
- a second plurality of protrusions projects from the planar face(s),
- said second plurality of protrusions comprises teeth of different heights,
- said second plurality of protrusions comprises teeth of which the height is less when adjacent to the central region of the core compared with the height of the other teeth of the second plurality of protrusions, in order to give the applicator a curved envelope,
- the protrusions have a semi-circular cross section,
- the protrusions each have a planar surface,
- the protrusions are positioned such that planar surfaces of two adjacent protrusions are oriented in the same rotational direction,
- the applicator forms a brush.

Figure 4:
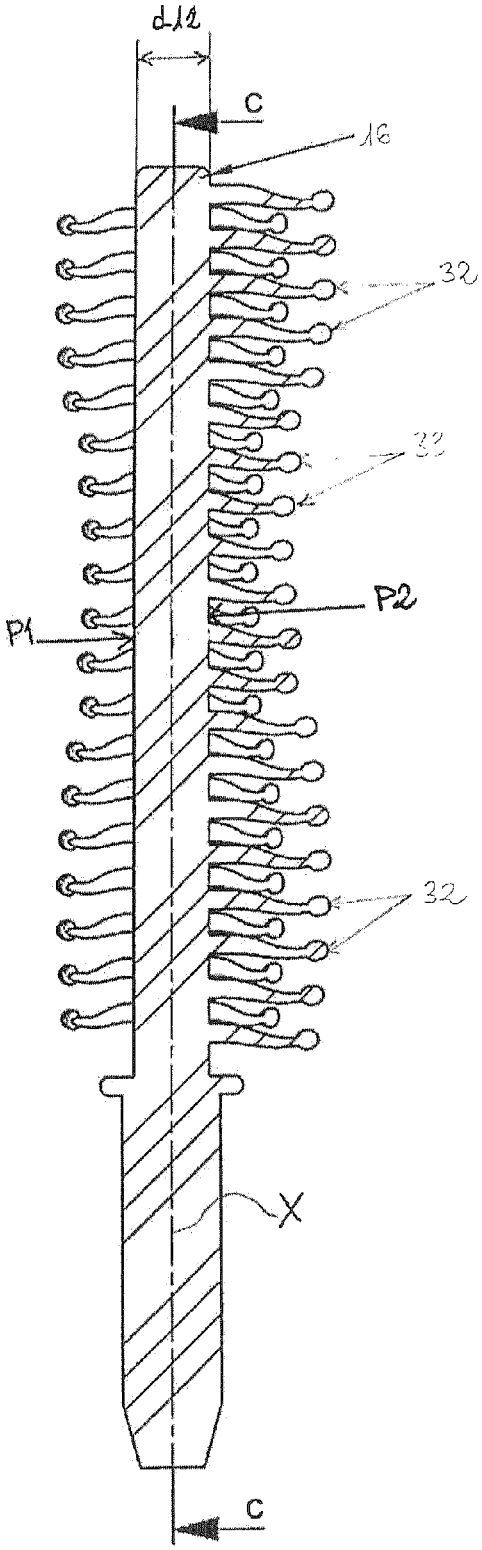
Figure 6A:
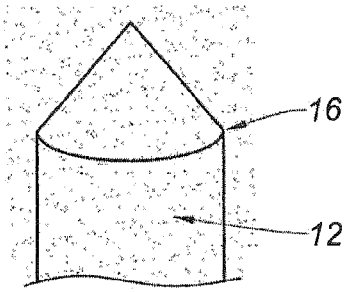
Fig. 6a Prior Art
Figure 7A:
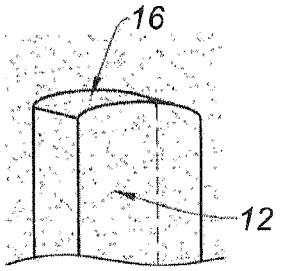
Figure 6B:
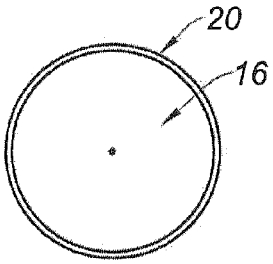
Fig. 6b Prior Art
Figure 6B:
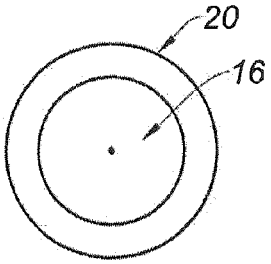
Fig. 6b' Prior Art
Figure 7B:
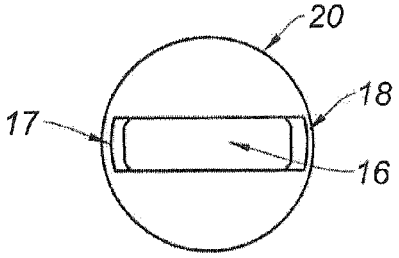
Figure 6C:
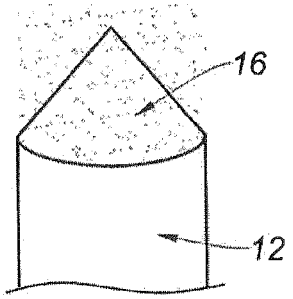
Fig. 6c Prior Art
Figure 7C:
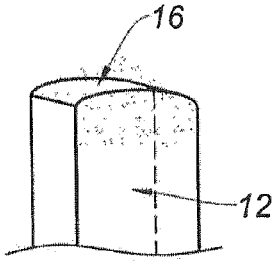

The invention will be better understood and other aims, details, features and advantages thereof will become more apparent upon reading the following detailed explanatory description of at least one embodiment of the invention given purely by way of illustrative and non-limiting example with reference to the accompanying schematic drawings, in which:

FIG. 1 is an elevated view of an applicator according to the invention,

FIG. 2 is an elevation of a wiper which may be used within the context of the invention, FIG. 3 shows the applicator from FIG. 1 when it is moved through the wiper from FIG. 2, the applicator being shown in a plan view and the wiper being shown in a bottom view, FIG. 4 is a cross section of FIG. 1 along the A-A axis, FIG. 5 is a cross section of FIG. 4 along the C-C axis, FIG. 6*a* is a schematic elevated view of an example of an end of an applicator according to the prior art, said end being immersed in cosmetic product, FIG. 6*b* is a schematic plan view of the applicator from FIG. 6*a* when it is moved through a wiper, FIG. 6*b'* is the same view as that in FIG. 6*b*, but showing a prior art variant, FIG. 6*c* again shows the applicator from FIG. 6*a*, but after it has passed through the wiper 20, FIG. 7*a* is a schematic elevated view of the end of the applicator from FIG. 1 immersed in cosmetic product, FIG. 7*b* is a schematic plan view of the applicator from FIG. 1 when it is moved through a wiper, FIG. 7*c* again shows the end of the applicator from FIG. 1, but after it has passed through the wiper.

The invention relates to an applicator assembly comprising a receptacle for a cosmetic product and an applicator sub-assembly comprising an applicator 10. In the drawings, only the applicator 10 and a wiper 20 have been shown, since many examples of applicator sub-assemblies and receptacles are well known for the remainder.

In the drawings, the wiper 20 is shown in the form of a wiper ring; however, this is non-limiting.

The applicator 10 comprises a core 12 having a first end 14 capable of being attached to a rod of the applicator, and a second, free end 16. The wiper 20 is used to remove some of the product from the applicator 10 to prevent said applicator from becoming overloaded.

In this case, the core 12 has a rounded portion 11, at least adjacent to said second end 16. The rounded portion 11 defines, in at least one given direction, an external size d11 close to the internal diameter D21 of the wiper 20. The internal diameter D21 of the wiper 20 means the diameter of the hole through which the applicator is moved.

Therefore, when the applicator is moved through the wiper 20, the rounded portion 11 is designed to brush past the wiper 20 in a plurality of distinct regions 17, 18. Said rounded portion 11 may more or less extend in the direction of the opposite end of the applicator such that, in a variant, the core has distinct regions 17, 18 intended to brush past the wiper without said regions necessarily being connected to a rounded region.

For example, said external size d11 may be 4 mm and the internal diameter D21 of the wiper may be 4.3 mm. This means, for example, that the play between the core and the wiper, at least adjacent to said regions 17, 18 intended to brush past the wiper, is 0.15 mm.

The wiper deforms when the applicator is passing therethrough. However, despite the deformation of the wiper, the contact between the rounded portion 11 and the wiper 20 is contact in which one brushes past the other in a plurality of distinct regions 17, 18. In other words, there is slight play, or slight friction, between the core and the wiper in a plurality of distinct regions 17, 18, even when the wiper deforms.

FIG. 1 shows an applicator 10 according to the invention. The core 12 of the applicator 10 shown has, in this front view, three distinct portions: a first rounded portion 11 adjacent to its second end 16, a second rounded portion 15 adjacent to its first end 14, and a narrowed portion 13 located in a region referred to as the central region of the core 12, located between said two rounded portions 11, 15.

FIG. 5 shows these portions 11, 13, 15 in detail. It may be noted that the external size d11 of the first rounded portion 11 is less than the external size d15 of the second rounded portion 15. Sizes d11, d15 are the maximum width that the rounded portions 11, 15 can occupy. The narrowed portion 13 has a size d13 that is less than the two preceding sizes d11, d15. Said narrowed portion 11 preferably has a concave orientation.

The rounded portions 11, 15 can be seen in FIGS. 1 and 5. However, they cannot be seen in FIG. 4. In fact, in this case the core 12 comprises two substantially planar faces P1, P2 as well as lateral surfaces L1, L2 connecting said planar faces (see reference signs in FIGS. 2 and 5). The rounded 11, 15 and narrowed 13 portions give the lateral surfaces L1, L2 an undulating profile.

In other words, only the lateral surfaces L1, L2 will be wiped.

Since FIGS. 1 and 5 resemble front views, they show the substantially planar faces P1, P2, each having its periphery dictated by the rounded and narrowed portions of the lateral surfaces L1, L2. On the other hand, although the core has a cross section of which the dimensions vary from its first end 14 to its free end 16, the shape, when viewed in cross section, of the core 12 does not vary and remains in an elongate, in particular substantially rectangular, configuration, said cross section being taken in a plane orthogonal to the longitudinal axis X of the core 12.

In other words, said section has the same shape in whatever position it is taken along the longitudinal axis X. In the embodiment shown here, this section remains rectangular with large faces and/or rounded edges even if the dimensions of said section vary along the axis X.

Owing to an elongate shape of this type, solely local wiping of the core is promoted. By way of example, a width to length ratio of said section is advantageously less than 0.5, even less than 0.2, in particular in the regions 17, 18 intended to brush past the wiper.

As can be seen in FIG. 1, the applicator 10 further comprises a plurality of protrusions 30 which project from the core 12.

FIG. 5 shows a first plurality of protrusions 30 which project from the lateral surfaces L1, L2. These protrusions 30 comprise teeth 31 of the same height.

Therefore, since the core 12 has portions 11, 13, 15 of which the size varies from its first end 14 to its second end 16, the envelope formed by the free ends of said teeth 31 is not a cylinder, but rather a translation of the periphery dictated by the lateral surfaces L1, L2 and the rounded 11, 15 and narrowed 13 portions thereof. The apexes h11, h13, h15 of said envelope are shown in FIG. 1.

FIG. 4 shows a second plurality of protrusions 30 which project from the planar faces P1, P2. These protrusions comprise teeth 32, 33 of different heights. More specifically, said second plurality of protrusions 30 comprises teeth 33 of which the height is less when adjacent to the central region of the core 12 compared with the height of the teeth 32 projecting from the planar faces P1, P2 adjacent to the longitudinal ends thereof to give the applicator the overall curved shape that can be seen in FIG. 1.

This second plurality of protrusions allows there to be an external envelope that is substantially rotationally symmetrical about the longitudinal axis X of the applicator 10, the external envelope being defined by the first and second plurality of protrusions together.

The protrusions 30 also form rows of teeth. These rows of teeth are all parallel to an axis of the core 12, in particular the longitudinal axis of extension X of the core 12. In addition, these rows are regularly spaced over the periphery of said core 12 so as to form eight rows, for example (see FIG. 2).

The applicator of the invention has the following advantage, as shown in FIG. 3. When the applicator is moved through the wiper 20, the distinct regions 17, 18 of the core 12 configured to brush past said ring 20, in particular in the region of the rounded portion 11 positioned adjacent to the free end 16 of the core 12, cause the shearing of the excess cosmetic product which may be found on the end 16 of the brush 12 when the applicator is removed from the receptacle intended to contain the cosmetic product, this excess product being directed towards the portions of the core 12 positioned between the regions in which the applicator brushes past.

This shearing is obtained owing to very thorough wiping at a limited number of points, in this case two points, on the end of the applicator 10 when it passes through the wiper 20.

Advantageously, the end 16 of the core is not flat, otherwise there would be too much residue at the end of the applicator and this would therefore be difficult to shear. The end 16 of the core is also not pointed because, in addition to posing a risk to the user when applying the cosmetic product, there would be too much residue at the end of the applicator and this would therefore be difficult to shear.

The free end 16 is advantageously convex, in particular domed and/or rounded. In this case, it does not have any protrusions 30 and has a smooth appearance. It is preferably connected to the rounded portion 11 in a continuously convex manner, that is to say without making a groove or recess inside which residues of cosmetic product may accumulate.

There are two regions 17, 18 that are intended to brush past the wiper and they are opposite each other. They are positioned in the region of the apexes of the lateral surfaces L1, L2 that define them. In addition, the two regions 17, 18 designed to brush past the wiper 20 each comprise at most one protrusion 30 so as to not significantly increase the tensile force involved in removing the applicator from the receptacle.

Longitudinally, said regions 17, 18 intended to brush past the wiper are positioned close to said free end 16. In other words, the rounded portion 11 has a maximum cross section just after said free end 16, said cross section reducing slightly between said regions 17, 18 that are intended to brush past the wiper and said free end 16, that is to say the part of the brush that does not have any protrusions 30.

The various phenomena set out above are shown schematically in FIG. 6*a*-6*c*, in which the cosmetic product is represented by dots.

FIG. 6*a* is a front view of an applicator 10 loaded with cosmetic product before it passes through the wiper 20. In this drawing, it is noted that the end 16 of the core 12 is pointed.

FIG. 6*b* is a schematic plan view. It shows the passage of the applicator from FIG. 6*a* through the wiper 20. In this drawing, it is noted that the core brushes past the wiper 20 over its entire periphery.

FIG. 6*b'* is the same view as that from FIG. 6*b*. In this drawing, it is noted that the core does not brush past the wiper 20.

FIG. 6*c* again shows the applicator from FIG. 6*a*, but after it has passed through the wiper 20, whether said applicator has a cylindrical core of which the external diameter is close to the internal diameter of the wiper 20 (variant shown in FIG. 6*b*) or not (variant shown in FIG. 6*b*'). FIG. 6*c* shows the residue obtained on the end 16 of the core 12 in the case of these two variants (shown in FIGS. 6*b* and 6*b*').

It is noted that all of the excess product has accumulated in the extension of the core 12.

As in FIG. 6*a*, FIG. 7*a* is a front view of an applicator 10 loaded with cosmetic product before it passes through the wiper 20. However, in this case, the end 16 of the core 12 of the applicator 10 is domed and not pointed.

FIG. 7*b* shows the passage of the applicator from FIG. 7*a* through the wiper 20. It is noted that this is an applicator assembly according to the invention, in this case having two diametrically opposed regions in which the applicator brushes past.

FIG. 7*c* again shows the applicator from FIG. 7*a*, but after it has passed through the wiper 20. This drawing shows the residue obtained on the end 16 of the core 12. More specifically, since the cosmetic product is sticky, it is sufficient to cause the residue to brush past in only two distinct regions 17, 18 in order to shear it almost entirely.

It is in fact noted that the cosmetic product has been guided towards the large faces of the core 12, below its apex. In addition, the domed shape of said apex again allows the accumulation of excess product to be limited.

It should be noted that the core 12 is advantageously solid, made of plastics material and that the protrusions 30 are preferably integrally formed with said core.

On the other hand, in order to simplify the processes for manufacturing such an applicator 10, the protrusions 30 have a semi-circular cross section. They preferably each have a planar surface (see FIG. 3). Said protrusions 30 are positioned such that the planar surfaces of two adjacent protrusions are oriented in the same rotational direction about the core 12.

It should also be noted that the applicator advantageously forms a brush.

It should further be noted that variants are of course possible. In particular, in an additional embodiment, the applicator of the applicator assembly of the invention comprises a number of rounded portions that is different from two and a number of narrowed portions that is greater than or equal to two. It is also conceivable for the number of distinct regions that brush past the wiper to be different from two, or odd.

The invention claimed is:

1. Applicator assembly comprising a receptacle for a cosmetic product and an applicator sub-assembly, the applicator sub-assembly comprising an applicator and a rod, the applicator comprising a core having a first end capable of being attached to said rod, and a second, free end, said receptacle comprising a wiper for wiping some of the product on the rod and/or the applicator, characterised in that the core has a substantially rectangular cross section and its end it domed, the core has a rounded portion at least adjacent to said second end, such that the core is designed to brush past the wiper in a plurality of distinct regions said distinct regions to brush past the wiper being positioned in said rounded portion, the rounded portion has, in a given direction, an external size close to an internal diameter of the wiper, said regions intended to brush past the wiper being positioned on either side of said rounded portion in said given direction, and that the applicator comprises a plurality of protrusions projecting from the core, the plurality of regions intended to brush past the wiper comprising at most one protrusion.

2. Applicator assembly according to claim 1, wherein the core comprises two substantially planar faces.

3. Applicator assembly according to claim 2, wherein the core comprises lateral surfaces connecting the substantially planar faces, the rounded portion giving the lateral surfaces undulating profile.

4. Applicator assembly according to claim 1, wherein the core comprises another rounded portion adjacent to said first end.

5. Applicator assembly according to claim 4, wherein the core comprises at least one narrowed portion between the rounded portion adjacent to the first end and that adjacent to the second end.

6. Applicator assembly according to claim 1, wherein the core is solid.

7. Applicator assembly according to claim 1, wherein the protrusions have a semi-circular cross section.

8. Applicator assembly according to claim 1, wherein the protrusions each have a planar surface.

9. Applicator assembly according to claim 8, wherein the protrusions are positioned such that planar surfaces of two adjacent protrusions are oriented in the same rotational direction.

* * * * *